US006816045B2

(12) United States Patent
Bagalini

(10) Patent No.: US 6,816,045 B2
(45) Date of Patent: Nov. 9, 2004

(54) ADJUSTABLE CIRCUIT BREAKER MECHANISM

(75) Inventor: Dante Bagalini, Johannesburg (ZA)

(73) Assignee: Circuit Breaker Industries Ltd., Elandsfontein (ZA)

( * ) Notice: Subject to any disclaimer, the term of this patent is extended or adjusted under 35 U.S.C. 154(b) by 0 days.

(21) Appl. No.: 10/272,933

(22) Filed: Oct. 18, 2002

(65) Prior Publication Data

US 2003/0080838 A1 May 1, 2003

(30) Foreign Application Priority Data

Oct. 18, 2001 (ZA) ..... 2001/8584

(51) Int. Cl.[7] ..... H01H 9/00

(52) U.S. Cl. ..... 335/172; 335/38

(58) Field of Search ..... 335/18–42, 128–132, 335/167–176

(56) References Cited

U.S. PATENT DOCUMENTS 5,084,956 A * 2/1992 Saito et al. ..... 29/602.1

* cited by examiner

*Primary Examiner*—Tuyen T Nguyen
(74) *Attorney, Agent, or Firm*—Burns, Doane, Swecker & Mathis, LLP

(57) ABSTRACT

A circuit breaker mechanism comprises a coil which surrounds a tube in which a magnetic core can move against the urging of a spring. An armature is located adjacent the coil and moves transversely relative to the axis of the coil, with a head portion of the armature being attracted towards a pole piece of the mechanism, while a foot portion of the armature is attracted to the magnetic core. The armature is pivoted to a magnetic frame at a point between the head and foot portions, so that the magnetic force between the head portion and the pole piece is counteracted to some extent by the magnetic force between the foot portion and the magnetic core. This in turn depends on the position of the magnetic core in the tube, and the setting of an adjuster mechanism which spaces the foot portion closer to or further away from the core in use. The adjuster mechanism allows the instantaneous tripping characteristic of the mechanism to be adjusted in use.

13 Claims, 5 Drawing Sheets

ADJUSTABLE CIRCUIT BREAKER MECHANISM

BACKGROUND OF THE INVENTION

This invention relates to a circuit breaker mechanism.

In certain applications, it may be desirable for a circuit breaker to have an instantaneous tripping current which is relatively high, due to the type of load controlled by the circuit breaker. For example, when certain electric motors are started, they draw a high inrush current, which quickly reduces to a substantially lower operating current. A conventional circuit breaker, correctly rated according to the normal operating current of the motor, may trip due to the high inrush current when the motor is started, which is obviously undesirable, and may lead to the fitting of an unsuitably highly rated circuit breaker to alleviate the problem.

It is an object of the invention to provide a circuit breaker mechanism with a relatively high instantaneous tripping current characteristic.

SUMMARY OF THE INVENTION

A circuit breaker mechanism comprising:

a coil arranged to carry a load current and defining an axis;

a magnetic circuit including a pole piece aligned with the axis of the coil and arranged to concentrate magnetic flux due to current in the coil;

an armature supported adjacent the coil and movable transversely relative to the axis of the coil, the armature having a head portion which is attracted towards the pole piece under the influence of magnetic flux in the pole piece, thereby generating an operating moment on the armature, and a foot portion which is attracted to a part of the magnetic circuit remote from the pole piece, thereby generating an opposing moment on the armature.

The magnetic circuit may include a magnetic element movable towards the pole piece along the axis of the coil against the urging of a bias element, the magnetic element having a rest position adjacent the foot portion of the armature so that the opposing moment is greater when the magnetic element is in the rest position.

The magnetic element may be a magnetic core movable against a bias element from the rest position towards the pole piece.

Preferably, the magnetic core is movable in a tube of non-magnetic material against the urging of a spring located in the tube between the magnetic core and the pole piece.

The armature may comprise a length of magnetic material mounted pivotably to the magnetic frame at a pivot point intermediate the head and foot portions of the armature.

The armature may be formed from steel sheet or bar.

The head and foot portions of the armature preferably extend transversely from the armature at respective opposed ends thereof.

The mechanism may include an adjuster comprising a spacer element locatable between the foot portion of the armature and the magnetic element, and movable to vary the distance between the foot position and the magnetic element, thereby to adjust the instantaneous tripping characteristic of the circuit breaker mechanism.

The spacer element may comprise a cylindrical body of magnetic material mounted for rotation about the axis of the coil, the body being eccentric so as to move the foot portion of the armature towards or away from the magnetic element as the body is rotated.

Preferably, the adjuster has a tool engaging formation accessible via an opening in a housing for the circuit breaker mechanism, to permit adjustment of the instantaneous tripping characteristic of the circuit breaker mechanism after installation thereof in use.

BRIEF DESCRIPTION OF THE DRAWINGS

FIG. 2 is a similar diagram to that of FIG. 1 showing the armature; pulled in;

DESCRIPTION OF EMBODIMENTS

The first embodiment of the circuit breaker mechanism of the invention shown in FIGS. 1 to 5 is broadly similar to the mechanism described in South African patent specification number 94/4880, the contents of which are incorporated herein by reference. Essentially, the mechanism is an adaptation and enhancement of a so-called "Hydraulic Magnetic" circuit breaker of the kind manufactured by Circuit Breaker Industries Limited of South Africa.

Figure 1:
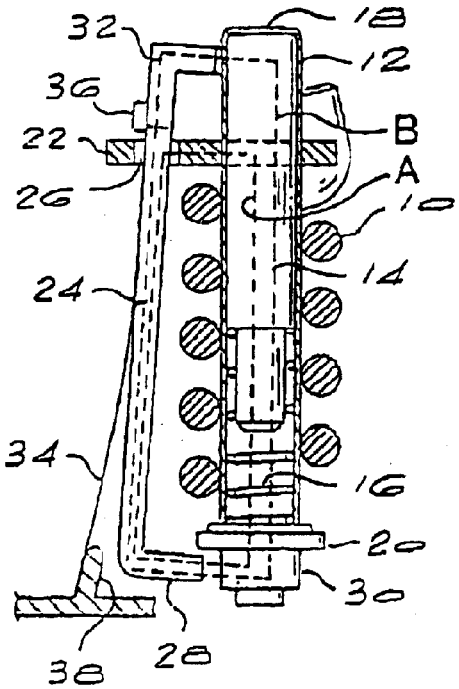
FIG. 1 is a schematic side view of a first embodiment of a circuit breaker mechanism according to the invention, with an armature of the mechanism in a rest position.
Figure 2:
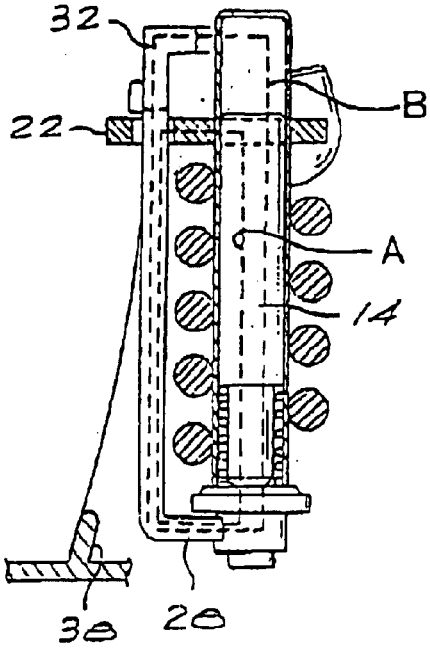
Figure 3:
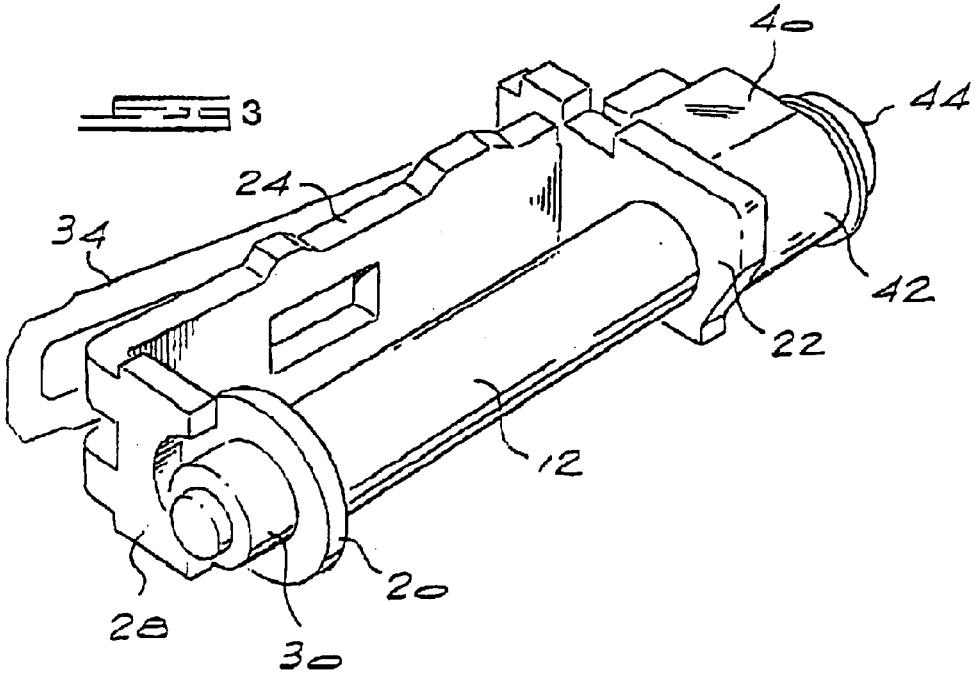
FIG. 3 is a pictorial view of the mechanism of FIGS. 1 and 2.
Figure 4:
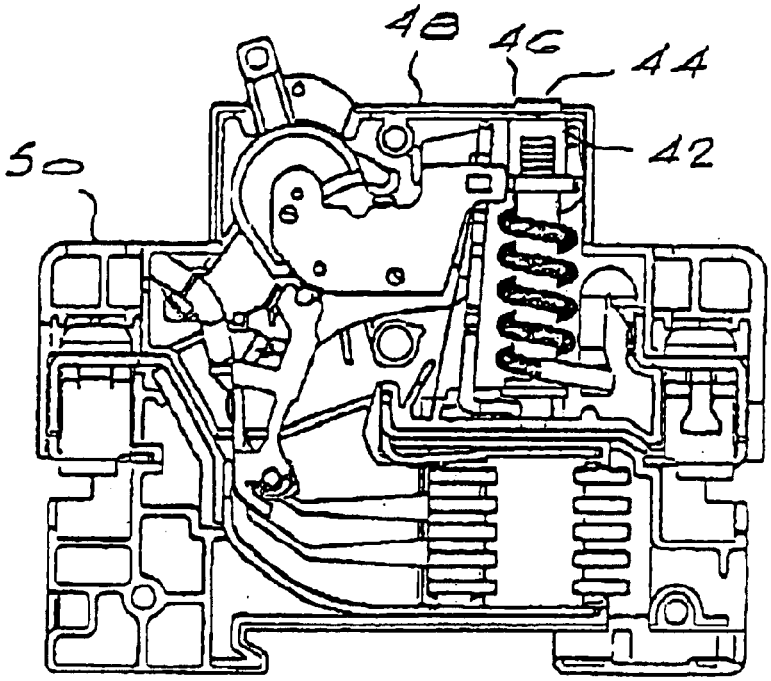
FIG. 4 is a side view of a circuit breaker incorporating the first embodiment of the mechanism of the invention, showing an adjuster of the mechanism in a first position.
Figure 5:
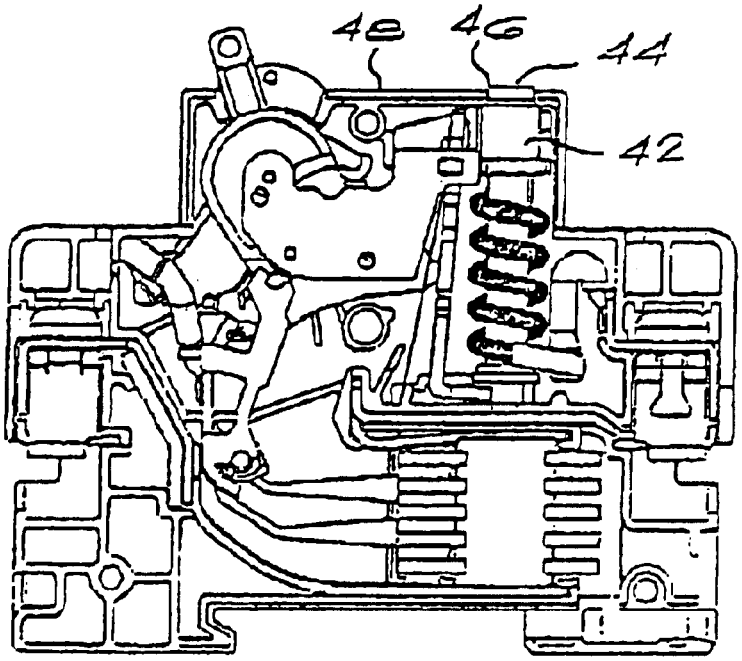
FIG. 5 is a view similar to that of FIG. 4, showing the adjuster in a second position.

Referring now to FIGS. 1, 2 and 3, the first embodiment of the circuit breaker mechanism of the invention comprises a cylindrical coil 10 disposed coaxially about a non-magnetic tube 12 which is filled with a hydraulic fluid and in which is movable a cylindrical magnetic core or plunger 14 against the urging of a coil spring 16. The tube 12 is closed at a first end 18 and is sealed by a magnetic pole piece 20 at its other end. The spring 16 acts between the inner end of the pole piece 20 and the core 14 to bias the core into a rest position away from the pole piece, as shown in FIG. 1.

A magnetic frame element 22 comprising a length of steel sheet or bar stock cut to size is fitted snugly around the tube 12 and supports an elongate armature 24 in an aperture 26 so that the armature can pivot transversely relative to the axis defined by the coil 10 and the tube 12. The armature 24 has a transversely extending head 28 with a curved end face which is shaped complementally to a cylindrical end portion 30 of the pole piece 20, and a transversely extending foot 32 which extends towards the end 18 of the tube 12. The foot 32, like the head 28, has an end face which defines a semicircular recess which in this case is shaped complementally to the outer surface of the tube 12.

The tube 12 can be drawn from brass, while the pole piece 20, the core 14, the magnetic frame element 22 and the armature 24 can be formed from mild steel having suitable magnetic properties.

A leaf spring 34 comprising a strip of phosphor bronze or another non-magnetic resilient material is fixed to the armature 24 towards the foot end thereof by means of a stacking operation, in which a hole in the lower end of the spring is fitted over a protrusion 36 formed on the rear surface of the armature, the protrusion 36 then being flattened to secure the spring. The other end of the spring bears against a ridge 38 formed in the moulded casing of a circuit breaker (or another suitable bearing point) to bias the head of the armature transversely away from the pole piece as shown in FIG. 1.

As indicated in FIG. 2, the circuit breaker mechanism defines a main magnetic circuit A between the magnetic frame element 22, the pole piece 30 and the upper portion of the armature 24 including the head 28, and an auxiliary magnetic circuit B defined between the magnetic frame element 22 and the lower portion of the armature 22 including the foot 32. The core 14 forms part of both circuits, and there is either an air-gap of variable size in the circuits, or not, depending on the position of the core.

FIG. 3 shows the mechanism of FIGS. 1 and 2 fitted with an adjuster mechanism 40. The mechanism 40 includes a cylindrical member 42 having a slotted head 44 and which fits rotatably about the end 18 of the tube 12. The sleeve 42 comprises magnetic material and is formed with a varying wall thickness, so that as the sleeve is rotated about the axis of the tube and coil, a varying thickness of the sleeve wall is interposed between the foot portion 32 of the armature and the outer wall of the tube 12. This causes the head 28 of the armature to move away from or towards the pole piece 30, which respectively increases or decreases the magnetic reluctance of the magnetic circuit A.

In operation, the circuit breaker mechanism described above effectively has a dual curve characteristic, with a high instantaneous tripping current. With the magnetic core 14 in the rest position shown in FIG. 1, corresponding to a situation where the load current in the coil 10 is well below the rated current of the circuit breaker, or where equipment supplied by the circuit breaker has just been switched on, there is a substantial air gap in the main magnetic circuit A between the pole piece 20 and the tip of the core 14. At the same time, the auxiliary magnetic circuit B will be substantially complete, due to the fact that the end of the core 14 is adjacent the foot 32 of the armature. In the event that the current in the coil 10 increases sharply, the foot 32 of the armature will be attracted to the core 14, counteracting the attraction between the head 28 of the armature and the pole piece 30 to some extent. It will be appreciated that the magnitude of this counter-moment will depend on, inter alia, the gap between the core and the pole piece, the length of the portion of the armature 24 on either side of the pivot point defined by the magnetic frame element 22, the spacing between the foot 32 and the core 14, and the spacing between the head 28 and the pole piece 20. The shape of the end faces of the head 28 and the foot 32 also determine the attraction characteristics thereof.

By adjusting the mechanism 40 to increase the reluctance of the main magnetic circuit A, the instantaneous tripping current of the mechanism is increased, and vice versa (i.e. there is an inverse relationship between the reluctance of the main magnetic circuit and the instantaneous tripping current). When the core 14 moves substantially towards the pole piece 20 due to a high load current in the coil 10, the reluctance of the auxiliary magnetic circuit is so great that it has virtually no effect on the conventional operation of the mechanism.

In the prototype circuit breaker, the various factors were adjusted to achieve an instantaneous tripping current of approximately $10I_N$ to $15I_N$, compared with the more conventional instantaneous tripping current values of $5I_N$ to $10I_N$ of a generally similar Hydraulic Magnetic circuit breaker without the auxiliary magnetic circuit.

The adjuster mechanism 40 allows the spacing between the foot 32 and the core 14 to be varied in use, thus varying the spacing between the head 28 and the pole piece 30 and allowing the instantaneous tripping current to be varied within a predetermined range to adjust the circuit breaker to the load in question. In this regard, it can be seen from FIGS. 4 and 5 that the slotted head 44 of the adjuster mechanism 40 protrudes slightly through an aperture 46 in the front face 48 of a moulded circuit breaker housing 50 in which the circuit breaker mechanism is contained. This allows a user easy access to the adjuster mechanism.

Figure 6:
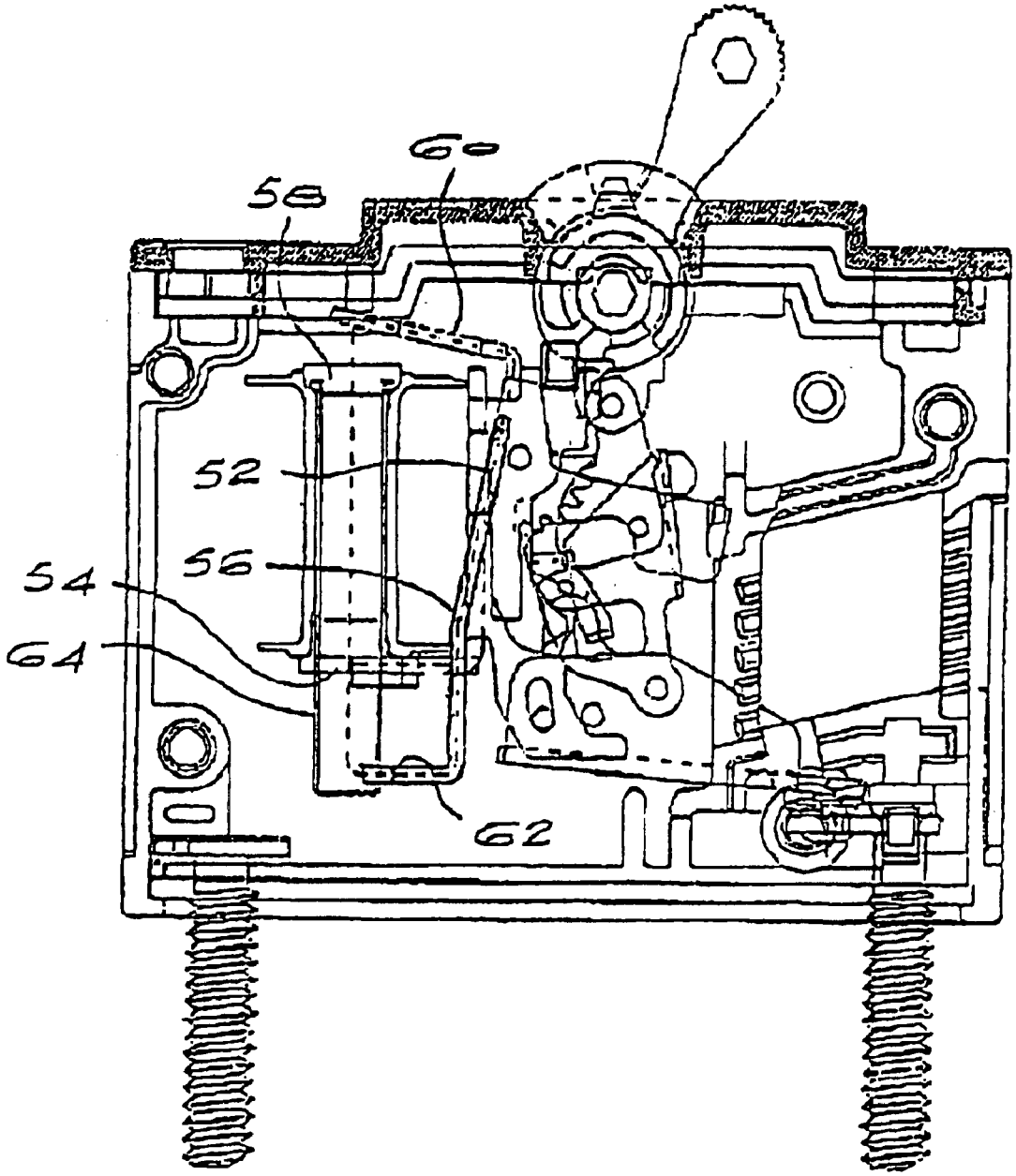
FIG. 6 is a side view of a circuit breaker incorporating a second embodiment of the mechanism of the invention, in a non-adjustable form.
Figure 7:
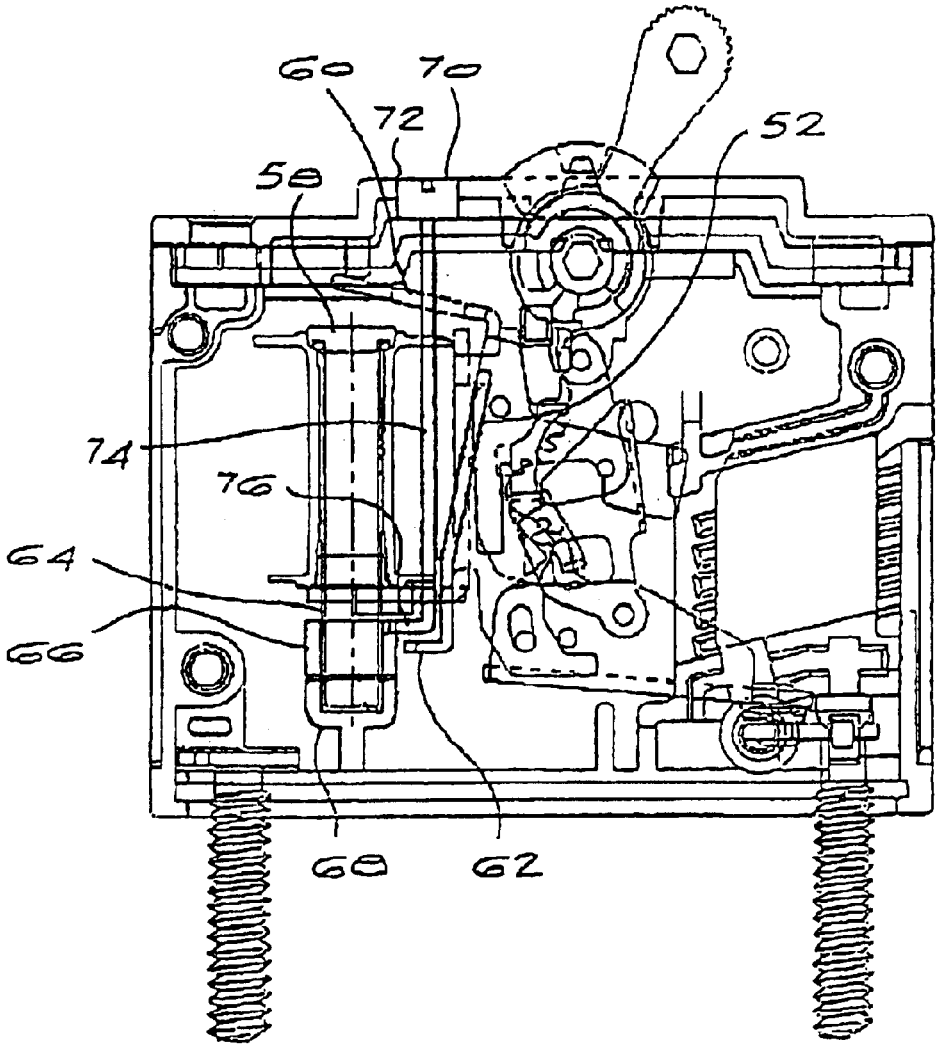
FIGS. 7 & 8 are side views of a circuit breaker similar to that shown in FIG. 6, but having an adjustable mechanism, and showing the mechanism in two different positions.
Figure 8:
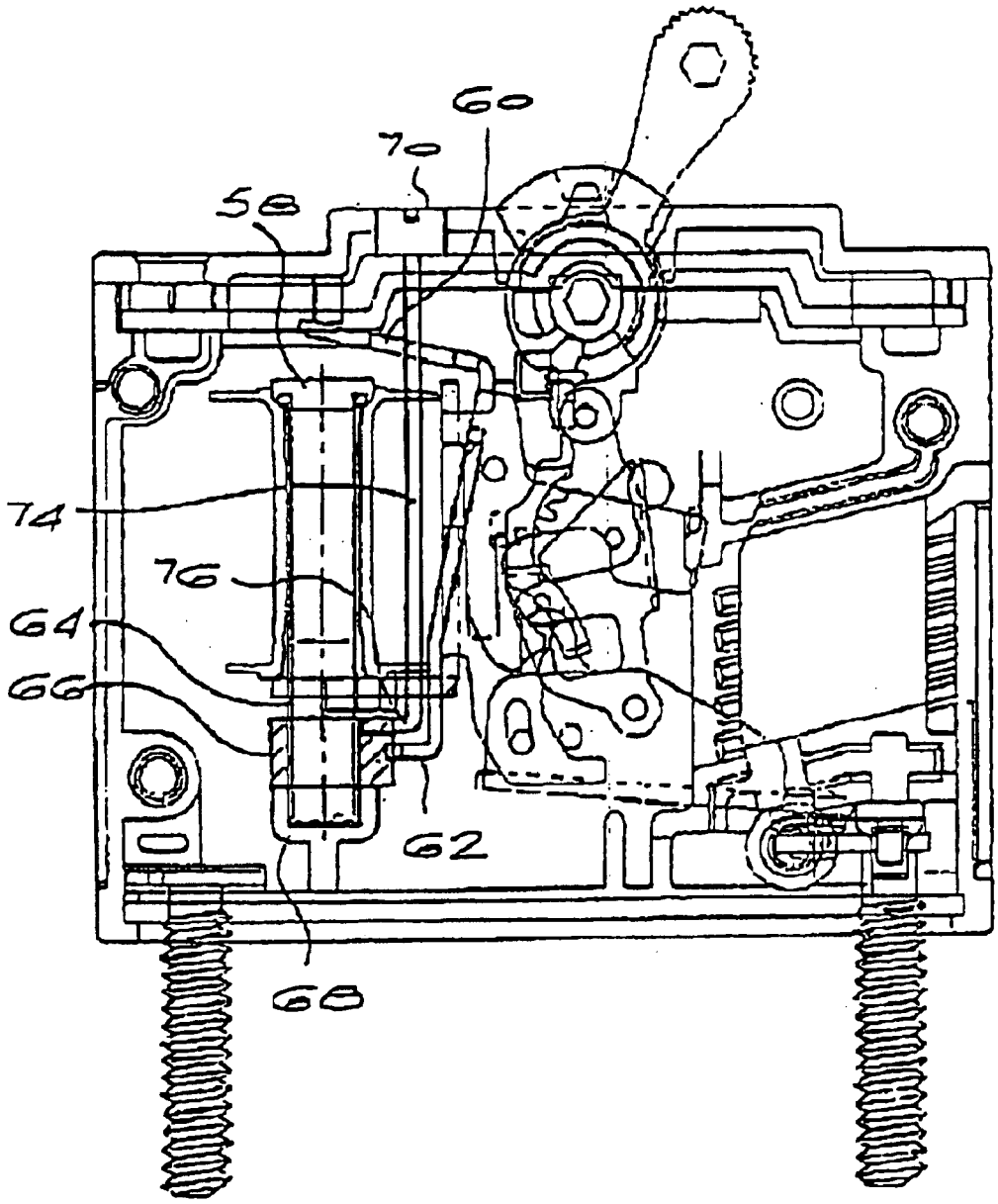

FIGS. 6, 7 and 8 show an alternative embodiment of the circuit breaker mechanism of the invention. In this embodiment, the armature 52 is also mounted pivotally on a magnetic frame element 54, but it is formed with a kink 56 adjacent the magnetic frame element on the side thereof closer to the pole piece 58, and has an extended head portion 60 which extends transversely over the end of the pole piece. In this embodiment, the head portion 60 of the armature is attracted axially towards the end of the pole piece 58, rather than being attracted transversely towards the pole piece. In other respects, functioning of this embodiment of the invention is substantially similar to the first embodiment described above.

The version of the second embodiment of the mechanism shown in FIG. 6 is non-adjustable. In other words, the clearance between the foot portion 62 of the armature and the tube 64 which carries the movable magnetic core is fixed. Accordingly, the gap between the head portion 60 of the armature and the end of the pole piece 58 is also fixed (assuming that the armature is in its rest position).

FIGS. 7 and 8 show a variation of the mechanism in which an adjuster is provided, similar to the adjuster mechanism of the first embodiment. A sleeve 66 formed of magnetic material and having a varying wall thickness is fitted rotatably about the end of the tube 64 adjacent the foot portion 62 of the armature. The end of the tube 64 remote from the pole piece rests in a supporting formation 68 defined internally in the circuit breaker housing. An adjuster screw 70 is provided in an aperture 72 in the front panel of the circuit breaker housing, and rotates an adjuster rod 74 which has a finger 76 at the end thereof remote from the screw 70. The finger engages a cavity or other engaging formation in the sleeve 66 so that rotation of the adjuster screw 70 through about 90° causes corresponding rotation of the sleeve 66 about the tube 64. This rotation moves the foot portion 62 of the armature closer to or further away from the tube 64 and thus the magnetic core, and correspondingly increases or decreases the air gap between the head 60 of the armature and the pole piece 58, with similar results to those described above with reference to the first embodiment.

The described circuit breaker mechanism is particularly suited to controlling loads which have high inrush current characteristics. Specific advantages of the described mechanism compared with conventional Hydraulic Magnetic circuit breakers include the following:

- Medium and high instantaneous tripping current levels can be achieved with relatively small core gaps, requiring less space for the trip assembly.
- The instantaneous tripping current is varied externally to the tube, therefore one tube design can provide low, medium and high instantaneous tripping current settings.

With a relatively simple mechanism, which can vary externally the reluctance of the magnetic circuit, an adjustable magnetic circuit-breaker of hydraulic magnetic construction can be designed.

The force applied by the armature during tripping is not reduced as in other very high instantaneous tripping current circuit breakers.

A motor circuit breaker providing a "start" and a "running" tripping characteristic, with or without adjustable instantaneous tripping settings, can be designed with this arrangement.

I claim:

1. A circuit breaker mechanism comprising:

a coil arranged to carry a load current and defining an axis;

a magnetic circuit including a pole piece aligned with the axis of the coil and arranged to concentrate magnetic flux due to current in the coil;

an armature supported adjacent the coil and movable transversely relative to the axis of the coil, the armature having a head portion which is attracted towards the pole piece under the influence of magnetic flux in the pole piece, thereby generating an operating moment on the armature in a first direction, and a foot portion which is attracted to a part of the magnetic circuit remote from the pole piece, thereby generating an opposing moment on the armature in a second direction substantially opposite the first direction.

2. A circuit breaker mechanism according to claim 1 wherein the magnetic circuit includes a magnetic element movable towards the pole piece along the axis of the coil against the urging of a bias element, the magnetic element having a rest position adjacent the foot portion of the armature so that the opposing moment is greater when the magnetic element is in the rest position.

3. A circuit breaker mechanism according to claim 2 wherein the magnetic element is a magnetic core movable against a bias element from the rest position towards the pole piece.

4. A circuit breaker mechanism according to claim 3 wherein the magnetic core is movable in a tube of non-magnetic material against the urging of a spring located in the tube between the magnetic core and the pole piece.

5. A circuit breaker mechanism according to claim 1 wherein the armature comprises a length of magnetic material mounted pivotably to the magnetic frame at a pivot point intermediate the head and foot portions of the armature.

6. A circuit breaker mechanism according to claim 5 wherein the armature is formed from steel sheet or bar.

7. A circuit breaker mechanism according to claim 5 wherein the head and foot portions extend transversely from the armature at respective opposed ends thereof.

8. A circuit breaker mechanism according to claim 2 wherein the mechanism includes an adjuster comprising a spacer element locatable between the foot portion of the armature and the magnetic element, and movable to vary the distance between the foot position and the magnetic element, thereby to adjust the instantaneous tripping characteristic of the circuit breaker mechanism.

9. A circuit breaker mechanism according to claim 8 wherein the spacer element comprises a cylindrical body of magnetic material mounted for rotation about the axis of the coil, the body being eccentric so as to move the foot portion of the armature towards or away from the magnetic element as the body is rotated.

10. A circuit breaker mechanism according to claim 9 wherein the adjuster has a tool engaging formation accessible via an opening in a housing for the circuit breaker mechanism, to permit adjustment of the instantaneous tripping characteristic of the circuit breaker mechanism after installation thereof in use.

11. A circuit breaker mechanism comprising:

a coil arranged to carry a load current and defining an axis;

a magnetic circuit including a pole piece aligned with the axis of the coil and arranged to concentrate magnetic flux due to current in the coil;

an armature supported adjacent the coil and movable transversely relative to the axis of the coil, the armature having a head portion which is attracted towards the pole piece under the influence of magnetic flux in the pole piece, thereby generating an operating moment on the armature, and a foot portion which is attracted to a part of the magnetic circuit remote from the pole piece, thereby generating an opposing moment on the armature;

wherein the magnetic circuit includes a magnetic element movable towards the pole piece along the axis of the coil against the urging of a bias element, the magnetic element having a rest position adjacent the foot portion of the armature so that the opposing moment is greater when the magnetic element is in the rest position;

the mechanism includes an adjuster comprising a spacer element locatable between the foot portion of the armature and the magnetic element, and movable to vary the distance between the foot position and the magnetic element, thereby to adjust the instantaneous tripping characteristic of the circuit breaker mechanism.

12. A circuit breaker mechanism according to claim 11 wherein the spacer element comprises a cylindrical body of magnetic material mounted for rotation about the axis of the coil, the body being eccentric so as to move the foot portion of the armature towards or away from the magnetic element as the body is rotated.

13. A circuit breaker mechanism according to claim 12 wherein the adjuster has a tool engaging formation accessible via an opening in a housing for the circuit breaker mechanism, to permit adjustment of the instantaneous tripping characteristic of the circuit breaker mechanism after installation thereof in use.

* * * * *